US006603265B2

(12) United States Patent
Ahn et al.

(10) Patent No.: US 6,603,265 B2
(45) Date of Patent: Aug. 5, 2003

(54) PLASMA DISPLAY PANEL HAVING TRIGGER ELECTRODES

(75) Inventors: Sung Yong Ahn, Kumi-shi (KR); Eun Cheol Lee, Kumi-shi (KR); Young Chan Park, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 185 days.

(21) Appl. No.: 09/768,005

(22) Filed: Jan. 24, 2001

(65) Prior Publication Data

US 2001/0026129 A1 Oct. 4, 2001

(30) Foreign Application Priority Data

Jan. 25, 2000 (KR) ..... P2000-3518
Feb. 17, 2000 (KR) ..... P2000-7655

(51) Int. Cl.[7] ..... H01J 17/49; H01J 1/62; H01J 63/04

(52) U.S. Cl. ..... 313/586; 313/495; 313/582

(58) Field of Search ..... 313/582, 586, 313/587, 585, 495, 496, 497

(56) References Cited

U.S. PATENT DOCUMENTS 5,182,489 A * 1/1993 Sano ..... 313/586
5,703,437 A * 12/1997 Komaki ..... 313/586
5,952,782 A * 9/1999 Nanto et al. ..... 313/582
5,977,708 A * 11/1999 Amatsu et al. ..... 313/586
6,084,349 A * 7/2000 Ueoka et al. ..... 313/587
6,222,316 B1 * 4/2001 Park ..... 313/582
6,297,590 B1 * 10/2001 Nanto et al. ..... 313/586
6,437,505 B1 * 8/2002 Baret et al. ..... 313/582
6,459,201 B1 10/2002 Schermerhorn et al.

FOREIGN PATENT DOCUMENTS

JP 9-35644 * 2/1997
JP 11-288667 * 10/1999
JP 2000-306517 * 11/2000

* cited by examiner

*Primary Examiner*—Susan S. Y. Lee
(74) *Attorney, Agent, or Firm*—Fleshner & Kim, LLP

(57) ABSTRACT

A plasma display panel that is capable of improving the discharge and light-emission efficiencies and the brightness. In the panel, a sustaining electrode pair is formed on an upper substrate in such a manner to be positioned at the edges of a discharge cell. A trigger electrode pair is positioned between the sustaining electrode pair to cause a trigger discharge for deriving a sustaining discharge. Dielectric layers are formed on the sustaining electrode pair and the trigger electrode pair to have a different thickness.

29 Claims, 8 Drawing Sheets

PLASMA DISPLAY PANEL HAVING TRIGGER ELECTRODES

BACKGROUND OF THE INVENTION

1. Field of the Invention

This invention relates to a flat panel display device, and more particularly to a plasma display panel that is capable of improving the discharge and light-emission efficiencies and the brightness.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current (AC) driving system. The DC-type PDP causes an opposite discharge between an anode and a cathode provided at a front substrate and a rear substrate, respectively to display a picture. On the other hand, the AC-type PDP allows an alternating voltage signal to be applied between electrodes having dielectric layer therebetween to generate a discharge every half-period of the signal, thereby displaying a picture. Since such an AC-type PDP uses a dielectric material which allows a wall charge to be accumulated on the surface thereof upon discharge, it produces a memory effect.

Referring to FIG. 1, the AC-type PDP includes a front substrate 10 provided with a sustaining electrode 12, and a rear substrate 20 provided with an address electrode 22. The front substrate 10 and the rear substrate 20 are spaced in parallel to each other with having a barrier rib 26 therebetween. A mixture gas, such as Ne—Xe or He—Xe, etc., is injected into a discharge space defined by the front substrate 10, the rear substrate 20 and a barrier rib 26. The sustaining electrode 12 makes a pair by two within a single of plasma discharge channel. Any one of the pair of sustaining electrode 12 is used as a scanning/sustaining electrode that responds to a scanning pulse applied in an address interval to cause an opposite discharge along with the address electrode 22 while responding to a sustaining pulse applied in a sustaining interval to cause a surface discharge with the adjacent sustaining electrodes 12. Also, the remaining one of the sustaining electrode pair 12 is used as a common sustaining electrode to which a sustaining pulse is applied commonly. On the front substrate 10 provided with the sustaining electrode pair 12, a dielectric layer 24 and a protective layer 18 are disposed. The dielectric layer 24 is responsible for limiting a plasma discharge current as well as accumulating a wall charge during the discharge. The protective film 18 prevents a damage of the dielectric layer 24 caused by the sputtering generated during the plasma discharge and improves the emission efficiency of secondary electrons. This protective film 18 is usually made from MgO. Barrier ribs 26 for dividing the discharge space is extended perpendicularly at the rear substrate 2. On the surfaces of the rear substrate 20 and the barrier ribs 26, a fluorescent material 28 excited by a vacuum ultraviolet lay to generate a visible light is provided.

In such an AC-type PDP, one frame consists of a number of sub-fields so as to realize gray levels by a combination of the sub-fields. For instance, when it is intended to realize 256 gray levels, one frame interval is time-divided into 8 sub-fields. Further, each of the 8 sub-fields is again divided into a reset interval, an address interval and a sustaining interval. The entire field is initialized in the reset interval. The discharge pixel cells on which a data is to be displayed are selected by the address discharge in the address interval. The selected cells sustain the discharge in the sustaining interval. The sustaining interval is lengthened by an interval corresponding to $2^n$ depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. The brightness and the chrominance of a displayed image are determined in accordance with a combination of the sub-fields.

As shown in FIG. 2, in the conventional PDP, the sustaining discharge begins at a portion between the sustaining electrode pair 12 to make a surface discharge at the surface of the sustaining electrode pair 12. Accordingly, the conventional PDP has a problem in that a light-emission area is extremely limited to have low brightness and efficiency. The brightness of such a PDP is proportional to a quantity of a vacuum ultraviolet ray generated during the discharge. In order to increase a generated quantity of a vacuum ultraviolet ray, there has been suggested a method of lengthening a distance between the sustaining electrode pair 12 to prolong a discharge path or a method of widening an electrode width of the sustaining electrode pair 12 to enlarge a discharge intensity. However, when a distance between the sustaining electrode pair 12 is large, a discharge length is prolonged to increase a generated quantity of a ultraviolet ray, but a discharge initiation voltage rises suddenly at more than a certain distance to cause a difficulty in a real application. When a width of the discharge-sustaining electrode is large, a generated quantity of an ultraviolet ray is increased in accordance with an increase of the discharge intensity. But, because a discharge current is increased in proportion to an electrode width, a wasted amount of the discharge current is increased to cause a disadvantage in respect of the efficiency.

SUMMARY OF THE INVENTION

Accordingly, it is an object of the present invention to provide a plasma display panel that is capable of improving the discharge and light-emission efficiency as well as the brightness.

In order to achieve these and other objects of the invention, a plasma display panel according to an embodiment of the present invention includes a sustaining electrode pair formed on an upper substrate in such a manner to be positioned at the edges of a discharge cell; a trigger electrode pair, being positioned between the sustaining electrode pair, to cause a trigger discharge for deriving a sustaining discharge; and dielectric layers formed on the sustaining electrode pair and the trigger electrode pair to have a different thickness.

A plasma display panel according to another embodiment of the present invention includes a sustaining electrode pair formed at a first distance on an upper substrate in such a manner to be positioned at the edges of a discharge cell; a first dielectric layer formed to entirely cover the sustaining electrode pair; a trigger electrode pair formed at a second distance larger than the first distance on the first dielectric layer; and a second dielectric layer formed to entirely cover the first dielectric layer and the trigger electrode pair.

A plasma display panel according to still another embodiment of the present invention includes a trigger electrode pair formed at a first distance on an upper substrate in such a manner to be positioned at the edges of a discharge cell; a first dielectric layer formed to entirely cover the trigger electrode pair; a sustaining electrode pair formed at a second distance larger than the first distance on the first dielectric layer; and a second dielectric layer formed on the first dielectric layer to entirely cover the sustaining electrode pair.

A plasma display panel according to still another embodiment of the present invention includes a sustaining electrode pair formed on an upper substrate in such a manner to be positioned at the edges of a discharge cell; a trigger electrode pair formed on the upper substrate in such a manner to be positioned between the sustaining electrode pair; and dielectric layers formed on the upper substrate to cover the sustaining electrode pair and the trigger electrode pair, said dielectric layers being designed such that the trigger electrode pair has a smaller dielectric constant than the sustaining electrode pair.

A plasma display panel according to still another embodiment of the present invention includes a sustaining electrode pair formed at a first distance on an upper substrate in such a manner to be positioned at the edges of a discharge cell; a first dielectric layer formed to entirely cover the sustaining electrode pair; a trigger electrode pair formed at a second distance larger than the first distance on the first dielectric layer; and a second dielectric layer formed on the first dielectric layer to entirely cover the trigger electrode pair and having a dielectric constant smaller than the first dielectric layer.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
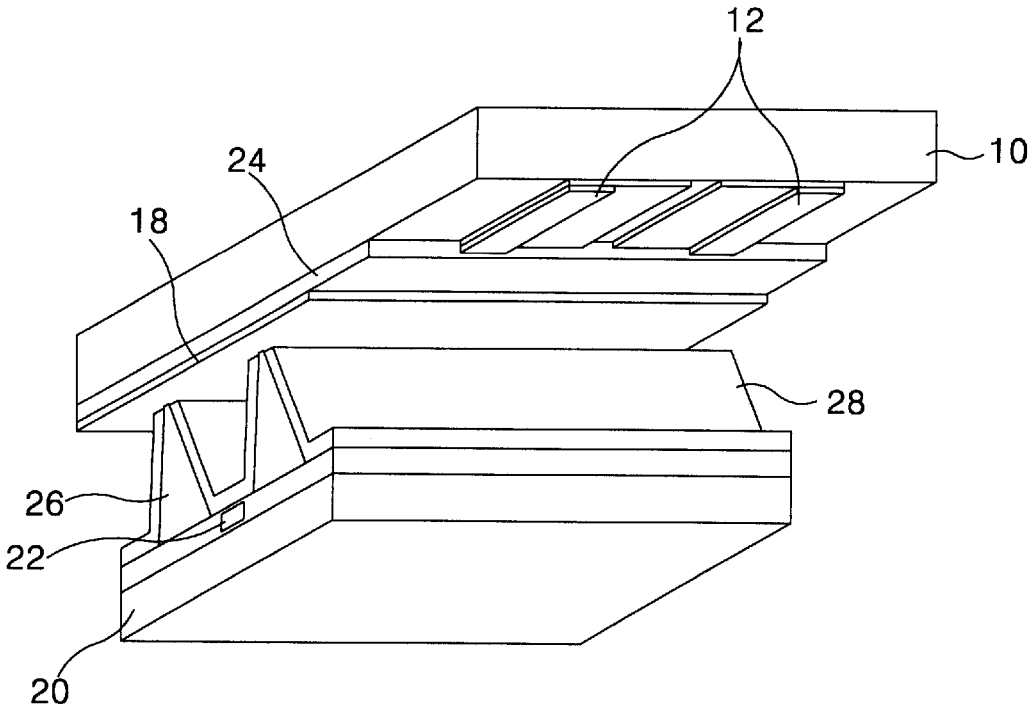
FIG. 1 CONVENTIONAL ART
FIG. 1 is a schematic perspective view showing the structure of a conventional three-electrode, AC surface-discharge plasma display panel.
Figure 2:
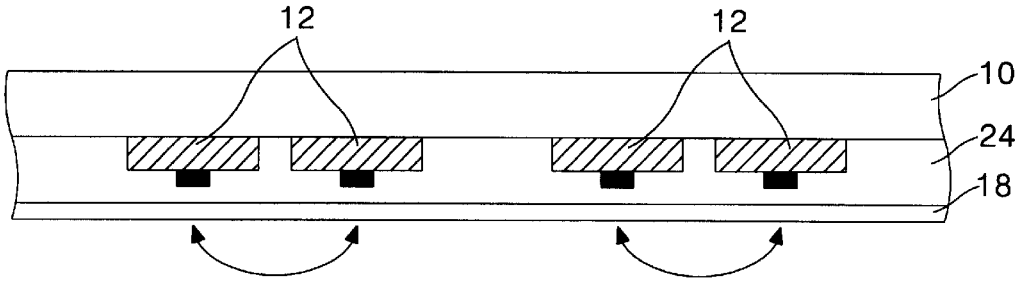
FIG.2 CONVENTIONAL ART
FIG. 2 is a section view of the front substrate of the discharge cell shown in FIG. 1.
Figure 3:
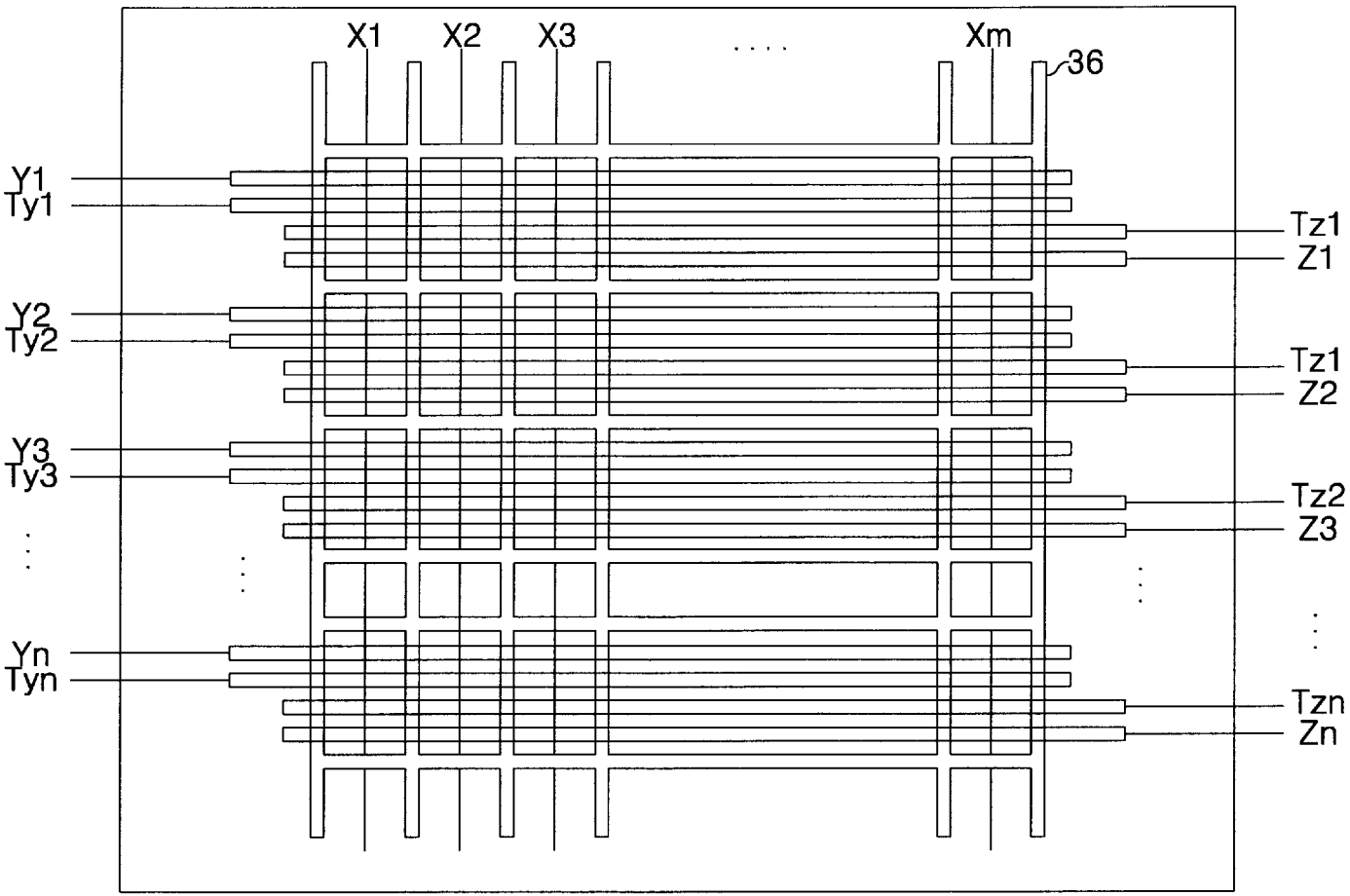
FIG. 3 is a plan view showing the structure of a plasma display panel according to a first embodiment of the present invention.
Figure 4:
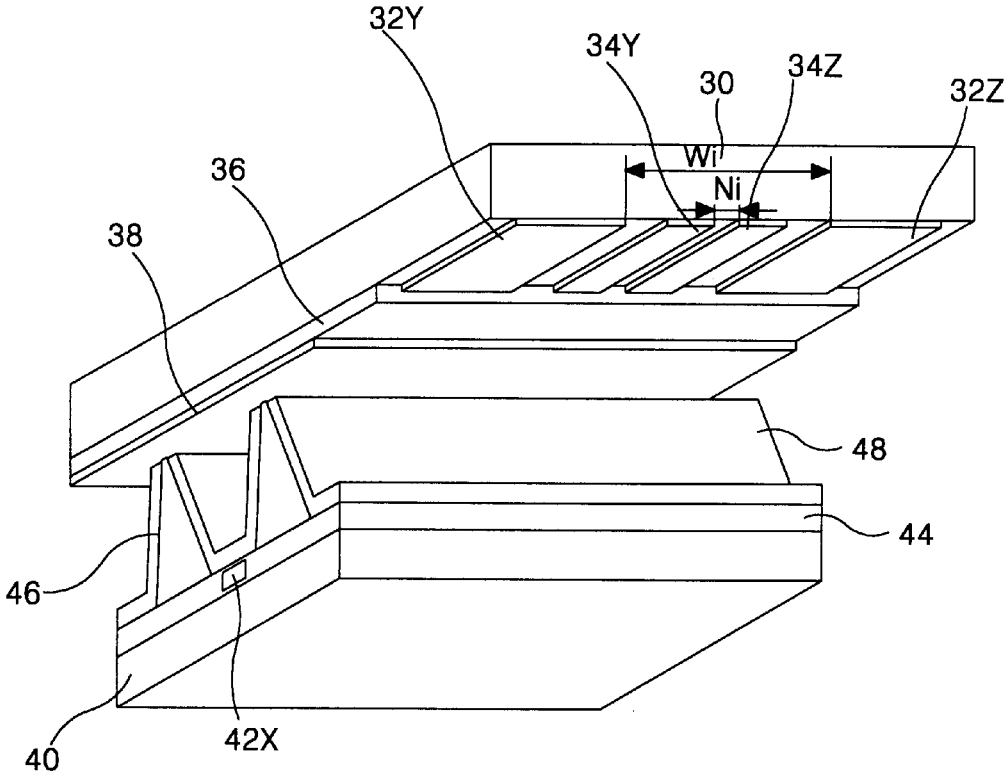
FIG. 4 is a perspective view showing a discharge cell structure of the plasma display panel in FIG. 3.
Figure 5:
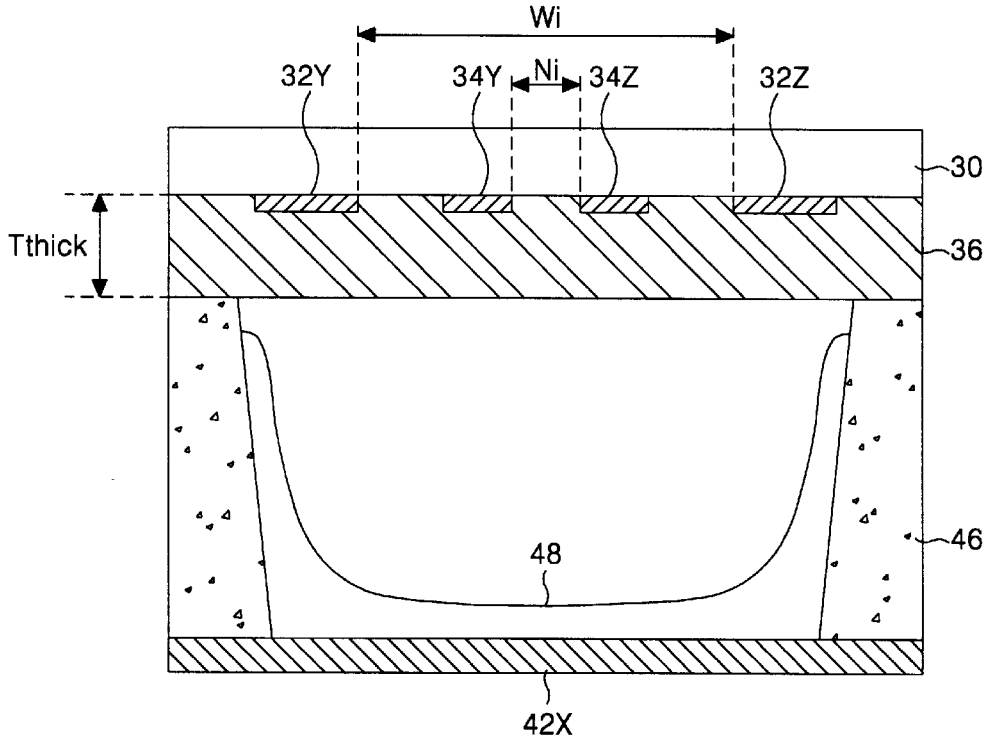
FIG. 5 is a schematic section view of the plasma display panel shown in FIG. 3.

FIG. 3 to FIG. 5 show a plasma display panel (PDP) according to a first embodiment of the present invention.

Referring to FIG. 3, the PDP includes sustaining electrode line pairs Y1 to Yn and Z1 to Zn having scanning/sustaining electrode lines Y1 to Yn and common sustaining electrode lines Z1 to Zn, trigger electrode line pairs Ty1 to Tyn and Tz1 to Tzn arranged, in parallel, between the sustaining electrode line pairs Y1 to Yn and Z1 to Zn, respectively, and address electrode lines X1 to Xm arranged in such a manner to cross the sustaining electrode pairs Y1 to Yn and Z1 to Zn and the trigger electrode pairs Ty1 to Tyn and Tz1 to Tzn. A discharge cell is formed at each intersection among the sustaining electrode line pairs Y1 to Yn and Z1 to Zn, the trigger electrode line pairs Ty1 to Tyn and Tz1 to Tzn and the address electrode lines X1 to Xm. The PDP further includes lattice-shaped barrier ribs 36 that provide an independent discharge space for each discharge cell to exclude an optical interference between the discharge cells.

In such a PDP, the discharge cells generating an address discharge between the scanning/sustaining electrode lines Y1 to Yn and the address electrode lines X1 to Xm generate a primary sustaining discharge by the trigger electrode line pairs Ty1 to Tyn and Tz1 to Tzn having a relatively small distance. Subsequently, the sustaining electrode line pairs Y1 to Yn and Z1 to Zn having a relatively large distance generate a secondary sustaining discharge by utilizing a priming effect resulted from the primary sustaining discharge. Such a sustaining discharge is continuously generated in a desired discharge-sustaining interval.

Referring now to FIG. 4 and FIG. 5, the AC surface-discharge PDP includes first and second trigger electrodes 34Y and 34Z formed on a front substrate 30 in such a manner to be positioned at the center of the discharge cell, a scanning/sustaining electrode 32Y and a common sustaining electrode 32Z formed on the front substrate 30 in such a manner to be positioned at the edges of the discharge cell, and an address electrode 42X formed at the center of a rear substrate 40 in a direction perpendicular to the trigger electrodes 34Y and 34Z and the sustaining electrodes 32Y and 32Z. On the front substrate in which the sustaining electrode pairs 32Y and 32Z and the trigger electrode pairs 34Y and 34Z are formed in parallel to each other, an upper dielectric layer 36 and a protective film 38 are disposed. A lower dielectric layer 44 and barrier ribs 46 are formed on the rear substrate 40 provided with the address electrode 42X, and a fluorescent material layer 48 is coated on the surfaces of the lower dielectric layer 44 and the barrier ribs 46. The trigger electrode pair 34Y and 34Z formed into a narrow distance Ni at the center of the discharge cell is responsible for receiving an AC pulse in the sustaining interval to initiate a sustaining discharge. On the other hand, the sustaining electrode pair 32Y and 32Z formed into a wide distance Wi at the edges of the discharge cell is responsible for receiving an AC pulse to sustain a plasma discharge after the discharge was initiated between the trigger electrode pair 34Y and 34Z.

In order to express gray levels of a picture, the present PDP divides one frame into various sub-fields having a different discharge frequency to drive it. Each sub-field is again divided into a reset interval for uniformly causing a discharge, an address interval for selecting a discharge cell and a sustaining interval for expressing gray levels in accordance with a discharge frequency.

In the reset interval, a reset pulse is applied to the second trigger electrode 34Z of the discharge cell to cause a reset discharge for initializing the discharge cell. In the address interval, a scanning pulse is sequentially applied to the first trigger electrode 34Y and a data pulse synchronized with the scanning pulse is applied to the address electrode 42X. At this time, an address discharge is generated at the discharge cell supplied with a data. In the sustaining interval, a different level of AC pulses is alternately applied to the trigger electrode pair 34Y and 34Z and the sustaining electrode pair 32Y and 32Z. First, when a discharge is initiated between the trigger electrode pair 32Y and 32Z, a secondary discharge is derived by a priming effect of charged particles generated at this time. Even though a distance Wi between the sustaining electrode pair 32Y and 32Z is large, a discharge is generated by a relatively low voltage level due to a priming discharge between the trigger electrode pair 34Y and 34Z. A discharge is primarily initiated by the trigger electrode pair 34Y and 34Z formed at a narrow distance Ni in this manner to restrain a rise of a discharge initiating voltage and to cause a sustaining discharge having a long discharge path between the sustaining electrode pair 32Y and 32Z by the priming effect.

Figure 6:
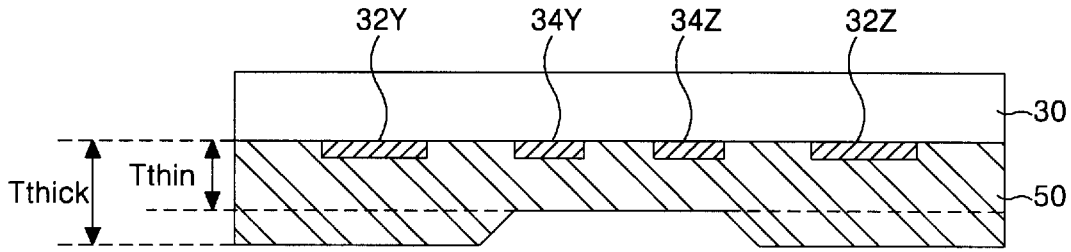
FIG. 6 is a section view showing the structure of a plasma display panel according to a second embodiment of the present invention.

FIG. 6 shows a plasma display panel (PDP) according to a second embodiment of the present invention.

Referring to FIG. 6, the PDP includes an upper dielectric layer 50 having a step coverage with respect to the edge thereof. The upper dielectric layer 50 is divided into a portion at which a sustaining electrode pair 32Y and 32Z and a portion at which the trigger electrode pair 34Y and 34Z is formed. The upper dielectric layer 50 formed on the scanning/sustaining electrode 32Y and the common sustaining electrode 32Z has a basic thickness Tthick like the first embodiment of the present invention. However, a thickness Tthin of the upper dielectric layer 50 formed on the trigger electrodes 34Y and 34Z is set to be smaller than the basic thick Tthick.

Herein, a capacitance decrease and a current decrease caused by an increase in a thickness of the dielectric layer will be described below. Generally, a capacitance C is proportional to a dielectric constant $\epsilon$ of the dielectric layer and a surface area of the electrode while being inversely proportional to a thickness d of the dielectric layer as seen from the following equation.

$$C=\epsilon A/d$$

In the above equation (1), as a thickness d of the dielectric layer is increased, a capacitance C is decreased. When the capacitance C is decreased, a current i also is decreased as seen from the following equation.

$$i=C(dv/dt)$$

In the above equation (2), a discharge current at an electrode having a small capacitance value is decreased while the majority of the discharge current is formed at an electrode having a large capacitance value, so that an improvement of the efficiency and the brightness according to an increase in a discharge distance can be obtained.

More specifically, in the reset interval, a reset pulse is applied to the second trigger electrode 34Z of the discharge cell to cause a reset discharge for initializing the discharge cell. At this time, since a thickness Tthin of the upper dielectric layer 50 formed on the second trigger electrode 34Z is set to be smaller than the basic thickness Tthick, a reset discharge can be generated by a low voltage. In the address interval, a scanning pulse is sequentially applied to the first trigger electrode 34Y and a data pulse synchronized with the scanning pulse is applied to the address electrode 42X. At this time, an address discharge is generated at the discharge cell supplied with a data. In the sustaining interval, a different level of AC pulses is alternately applied to the trigger electrode pair 34Y and 34Z and the sustaining electrode pair 32Y and 32Z. First, a primary discharge is initiated between the trigger electrode pair 34Y and 34Z to produce charged particles. At this time, since a thickness Tthin of the upper dielectric layer 36 formed on the trigger electrode pair 34Y and 34Z is set to be less than the basic thickness Tthick, a voltage drip caused by the upper dielectric layer 36 is reduced. In other words, a primary discharge can be generated between the trigger electrode pair 34Y and 34Z by a voltage corresponding to the reduced voltage drop of the upper dielectric layer 36. When a discharge is initiated between the trigger electrode pair 34Y and 34Z, a secondary discharge between the sustaining electrode pair 32Y and 32Z formed at the edges of the discharge cell is derived by a priming effect of charged particles generated at this time. Even though a distance between the sustaining electrode pair 32Y and 32Z is long, a long distance discharge can be generated by a sustaining pulse having a relatively low voltage level owing to the priming discharge between the trigger electrode pair 34Y and 34Z. a low voltage is applied to the trigger electrode pair 34Y and 34Z in this manner to cause a primary discharge, so that a rise of a discharge initiating voltage can be restrained and a sustaining discharge having a long discharge path can be generated between the sustaining electrode pair 32Y and 32Z by the priming effect.

Figure 7:
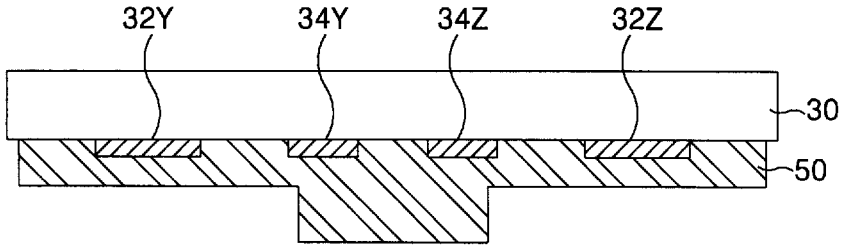
FIG. 7 is a section view showing the structure of a plasma display panel according to a third embodiment of the present invention.

FIG. 7 shows a plasma display panel (PDP) according to a third embodiment of the present invention.

Referring to FIG. 7, in the discharge cell, a trigger electrode pair 34Y and 34Z and a sustaining electrode pair 32Y and 32Z are formed at an equal height, whereas dielectric layers formed on the trigger electrode pair 34Y and 34Z and the sustaining electrode pair 32Y and 32Z are set to have a different thickness. More specifically, the trigger electrode pair 34Y and 34Z and the sustaining electrode pair 32Y and 32Z are arranged, in parallel, on a front substrate 30. The dielectric layer 50 on the trigger electrode pair 34Y and 34Z is formed to be thicker than the dielectric layer 50 on the sustaining electrode pair 34Y and 34Z. Accordingly, as mentioned above, a discharge current is decreased between the trigger electrode pair 34Y and 34Z while the majority of the discharge current is formed between the sustaining electrode pair 32Y and 32Z having a high efficiency.

Figure 8:
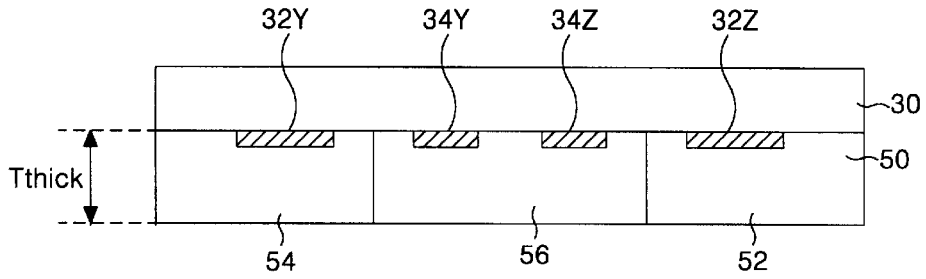
FIG. 8 is a section view showing the structure of a plasma display panel according to a fourth embodiment of the present invention.

FIG. 8 shows a plasma display panel (PDP) according to a fourth embodiment of the present invention.

Referring to FIG. 8, the PDP includes first and second dielectric layers 52, 54 and 56 having a different dielectric constant at the edges and the center thereof. The first and second dielectric layers 52, 54 and 56 are divided into a portion at which a sustaining electrode pair 32Y and 32Z is formed and a portion at which a trigger electrode pair 34Y and 34Z is formed. The first dielectric layers 52 and 54 formed on the sustaining electrode pair 32Y and 32Z keep a standard dielectric constant like the first embodiment of the present invention. However, a dielectric constant of the second dielectric layer 56 formed on the trigger electrode pair 34Y and 34Z is set to be smaller than the standard dielectric constant. Accordingly, even when voltage levels of a scanning pulse and a sustaining pulse of the trigger electrode pair 34Y and 34Z are lowered, an address discharge and a sustaining discharge can be generated.

Figure 9:
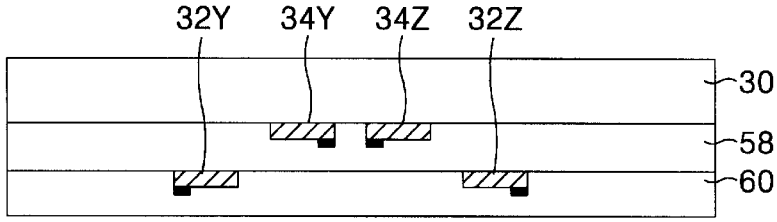
FIG. 9 is a section view showing the structure of a plasma display panel according to a fifth embodiment of the present invention.

FIG. 9 shows a plasma display panel (PDP) according to a fifth embodiment of the present invention.

Referring to FIG. 9, in the discharge cell, a trigger electrode pair 34Y and 34Z and a sustaining electrode pair 32Y and 32Z are formed in such a manner to be positioned at a different height, thereby differentiating a thickness of a dielectric layer corresponding thereto. In other words, the trigger electrode pair 34Y and 34Z is formed, in parallel, on a front substrate 30, and a first dielectric layer 58 is formed thereon. The sustaining electrode pair 32Y and 32Z is formed, in parallel, on the first dielectric layer 58 in such a manner to be positioned at the outer sides of the trigger electrode pair 34Y and 34Z, and a second dielectric layer 60 and a protective film 52 are disposed thereon. Thus, the first dielectric layer 58 formed on the trigger electrode pair 34Y and 34Z is set to be thicker than the second dielectric layer 60 formed on the sustaining electrode pair 32Y and 32Z, so that a discharge current is decreased between the trigger electrode pair 34Y and 34Z while the majority of the discharge current is formed between the sustaining electrode pair 32Y and 32Z having a high efficiency. As a result, a discharge between the trigger electrode pair 34Y and 34Z is decreased, whereas the majority of a discharge is generated between the sustaining electrode pair 32Y and 32Z having a long discharge distance.

Figure 10:
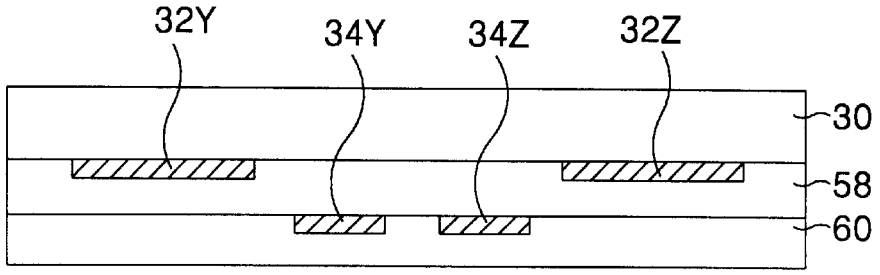
FIG. 10 is a section view showing the structure of a plasma display panel according to a sixth embodiment of the present invention.

FIG. 10 shows a plasma display panel (PDP) according to a sixth embodiment of the present invention.

Referring to FIG. 10, in the discharge cell, a dielectric layer of a trigger electrode pair 34Y and 34Z is set to have a small thickness, whereas a dielectric layer of a sustaining electrode pair 32Y and 32Z is set to have a large thickness. In other words, the sustaining electrode pair 32Y and 32Z is formed on a front substrate 30, and a first dielectric layer 58 is formed thereon. The trigger electrode pair 34Y and 34Z is formed on the first dielectric layer 58, and a second dielectric layer 60 is formed thereon. The second dielectric layer 60 on the trigger electrode pair 34Y and 34Z is set to have a small thickness, so that a voltage drop value caused by the second dielectric layer 60 is decreased to reduce a discharge initiating voltage. On the other hand, the first dielectric layer 58 on the sustaining electrode pair 32Y and 32Z has a relatively large thickness. As a thickness of the first dielectric layer 58 becomes larger, a discharge current is reduced during a main discharge of the sustaining electrode pair 32Y and 32Z to improve the efficiency.

Figure 11:
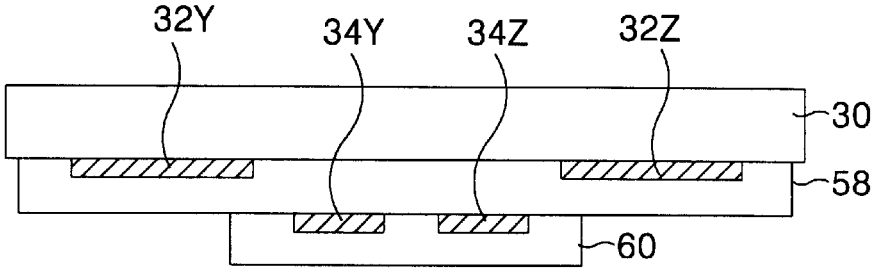
FIG. 11 is a section view showing the structure of a plasma display panel according to a seventh embodiment of the present invention.

FIG. 11 shows a plasma display panel (PDP) according to a seventh embodiment of the present invention.

Referring to FIG. 11, a dielectric layer 58 is formed into a relatively large thickness on a front substrate 30 provided with a sustaining electrode pair 32Y and 32Z, and a trigger electrode pair 34Y and 34Z is formed thereon. Alternatively, a dielectric layer 60 having a relatively small thickness may be formed only at a portion at which the trigger electrode pair 34Y and 34Z are positioned. In this case, since the dielectric layer 60 on the trigger electrode pair 34Y and 34Z has a small thickness, it can lower a discharge initiating voltage. On the other hand, since the dielectric layer 58 on the sustaining electrode pair 32Y and 32Z has a large thickness, it can reduce a discharge current during the main discharge.

As described above, according to the present invention, the trigger electrodes are formed at the center of the front substrate while the scanning/sustaining electrode and the common sustaining electrode are formed at the edges of the front substrate to cause a discharge at the edges of the discharge cell, so that a light-emission efficiency can be improved. Also, the dielectric layers of the trigger electrode pair and the sustaining electrode pair are set to have a different thickness or a different dielectric constant to lower a voltage drop caused by the dielectric layers and decrease a discharge current between the sustaining electrodes, so that the brightness and the discharge efficiency can be improved.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a sustaining electrode pair formed on an upper substrate in such a manner to be positioned at the edges of a discharge cell;

a trigger electrode pair, being positioned between the sustaining electrode pair, to cause a trigger discharge for deriving a sustaining discharge; and dielectric layers formed on the sustaining electrode pair and the trigger electrode pair to have a different thickness.

2. The plasma display panel as claimed in claim 1, further comprising:

an address electrode, being formed on a lower substrate opposed to the upper substrate, for causing an address discharge along with any one electrode of the trigger electrode pair.

3. A plasma display panel, comprising:

a sustaining electrode pair formed on an upper substrate in such a manner to be positioned at the edges of a discharge cell;

a trigger electrode pair, being positioned between the sustaining electrode pair, to cause a trigger discharge for deriving a sustaining discharge; and dielectric layers formed on the sustaining electrode pair and the trigger electrode pair to have a different thickness, wherein the dielectric layer on the trigger electrode pair is formed to have a larger thickness than the dielectric layer on the sustaining electrode pair such that a discharge current between the trigger electrode pair is decreased to form the majority of a discharge current between the sustaining electrode pair.

4. A plasma display panel, comprising:

a sustaining electrode pair formed on an upper substrate in such a manner to be positioned at the edges of a discharge cell;

a trigger electrode pair, being positioned between the sustaining electrode pair, to cause a trigger discharge for deriving a sustaining discharge; and dielectric layers formed on the sustaining electrode pair and the trigger electrode pair to have a different thickness, wherein the dielectric layer on the sustaining electrode pair is formed to have a larger thickness than the dielectric layer on the trigger electrode pair, thereby restraining a rise of a discharge initiating voltage and causing a sustaining discharge having a long discharge path between the sustaining electrode pair.

5. A plasma display panel, comprising:

a sustaining electrode pair formed at a first distance on an upper substrate in such a manner to be positioned at the edges of a discharge cell;

a first dielectric layer formed to entirely cover the sustaining electrode pair;

a trigger electrode pair formed at a second distance smaller than the first distance on the first dielectric layer; and a second dielectric layer formed to entirely cover the first dielectric layer and the trigger electrode pair.

6. The plasma display panel as claimed in claim 5, further comprising:

an address electrode, being formed on a lower substrate opposed to the upper substrate, for causing an address discharge along with any one electrode of the trigger electrode pair.

7. The plasma display panel as claimed in claim 5, wherein the second dielectric layer is formed to cover only an area at which the trigger electrode pair is positioned.

8. A plasma display panel, comprising:

a trigger electrode pair formed at a first distance on an upper substrate in such a manner to be positioned at the edges of a discharge cell;

a first dielectric layer formed to entirely cover the trigger electrode pair;

a sustaining electrode pair formed at a second distance larger than the first distance on the first dielectric layer; and a second dielectric layer formed on the first dielectric layer to entirely cover the sustaining electrode pair.

9. The plasma display panel as claimed in claim 8, further comprising:

an address electrode, being formed on a lower substrate opposed to the upper substrate, for causing an address discharge along with any one electrode of the trigger electrode pair.

10. The plasma display panel as claimed in claim 8, wherein the second dielectric layer is formed to cover only an area at which the sustaining electrode pair is positioned.

11. A plasma display panel, comprising:

a sustaining electrode pair formed on an upper substrate in such a manner to be positioned at the edges of a discharge cell;

a trigger electrode pair formed on the upper substrate in such a manner to be positioned between the sustaining electrode pair; and dielectric layers formed on the upper substrate to cover the sustaining electrode pair and the trigger electrode pair, said dielectric layers being designed such that the trigger electrode pair has a smaller dielectric constant than the sustaining electrode pair.

12. The plasma display panel as claimed in claim 11, further comprising:

an address electrode, being formed on a lower substrate opposed to the upper substrate, for causing an address discharge along with any one electrode of the trigger electrode pair.

13. The plasma display panel as claimed in claim 11, wherein the dielectric layer on the trigger electrode pair is formed to have a larger thickness than the dielectric layer on the sustaining electrode pair.

14. A plasma display panel, comprising:

a sustaining electrode pair formed at a first distance on an upper substrate in such a manner to be positioned at the edges of a discharge cell;

a first dielectric layer formed to entirely cover the sustaining electrode pair;

a trigger electrode pair formed at a second distance smaller than the first distance on the first dielectric layer; and a second dielectric layer formed on the first dielectric layer to entirely cover the trigger electrode pair and having a dielectric constant smaller than the first dielectric layer.

15. The plasma display panel as claimed in claim 14, further comprising:

an address electrode, being formed on a lower substrate opposed to the upper substrate, for causing an address discharge along with any one electrode of the trigger electrode pair.

16. The plasma display panel as claimed in claim 14, wherein the second dielectric layer is formed to cover only an area at which the trigger electrode pair is positioned.

17. A plasma display panel, comprising:

a pair of sustaining electrodes formed on a first substrate;

at least one trigger electrode positioned between the pair of sustaining electrodes; and dielectric layers having different thicknesses formed, respectively, over the pair of sustaining electrode pairs and the at least one trigger electrode.

18. The plasma display panel as claimed in claim 17, wherein the pair of sustaining electrodes are positioned at edges of a discharge cell and the at least one trigger electrode comprises a pair of trigger electrodes.

19. The plasma display panel as claimed in claim 17, wherein the dielectric layer formed over the pair of sustaining electrode pairs is thinner than the dielectric layer formed over the at least one trigger electrode.

20. The plasma display panel as claimed in claim 17, wherein the dielectric layer formed over the pair of sustaining electrode pairs is thicker than the dielectric layer formed over the at least one trigger electrode.

21. A plasma display panel, comprising:

a pair of sustaining electrodes formed on a first substrate;

at least one trigger electrode positioned between the pair of sustaining electrodes; and dielectric layers having different dielectric constants formed, respectively, over the pair of sustaining electrode pairs and the at least one trigger electrode.

22. The plasma display panel as claimed in claim 21, wherein the dielectric constant of the dielectric layer formed over the at least one trigger electrode is less than the dielectric constant of the dielectric layers formed over the pair of sustaining electrodes.

23. The plasma display panel as claimed in claim 21, wherein the pair of sustaining electrodes are positioned at edges of a discharge cell and the at least one trigger electrode comprises a pair of trigger electrodes.

24. A plasma display panel, comprising:

a pair of sustaining electrodes formed on a first substrate; and at least one trigger electrode positioned between the pair of sustaining electrodes, wherein the first substrate comprises a front substrate on which a first dielectric layer is formed, and wherein the at least one trigger electrode is formed on an inner surface of the front substrate and the pair of sustaining electrodes is formed on an inner surface of the first dielectric layer.

25. The plasma display panel as claimed in claim 24, further comprising a second dielectric layer formed over the pair of sustaining electrodes.

26. The plasma display panel as claimed in claim 24, wherein the pair of sustaining electrodes are positioned at edges of a discharge cell and the at least one trigger electrode comprises a pair of trigger electrodes.

27. A plasma display panel, comprising:

a pair of sustaining electrodes formed on a first substrate; and at least one trigger electrode positioned between the pair of sustaining electrodes, wherein the first substrate comprises a front substrate on which a first dielectric layer is formed, and wherein the pair of sustaining electrodes is formed on an inner surface of the front substrate and the at least one trigger electrode is formed on an inner surface of the first dielectric layer.

28. The plasma display panel as claimed in claim 27, further comprising a second dielectric layer formed over at least one trigger electrode.

29. The plasma display panel as claimed in claim 27, wherein the pair of sustaining electrodes are positioned at edges of a discharge cell and the at least one trigger electrode comprises a pair of trigger electrodes.

* * * * *